US005816998A

United States Patent [19]

Silverstolpe et al.

[11] Patent Number: 5,816,998

[45] Date of Patent: Oct. 6, 1998

[54] CENTRIFUGE FOR TEST TUBES AND CONTAINERS

[76] Inventors: Lennart Silverstolpe, Nockeby Backe 8 A, S-161 51 Bromma; Sante Olling, Hökegårdsgatan 69, S-431 38 Mölndal, both of Sweden

[21] Appl. No.: 809,091

[22] PCT Filed: Sep. 14, 1995

[86] PCT No.: PCT/SE95/01036

§ 371 Date: Jun. 12, 1997

§ 102(e) Date: Jun. 12, 1997

[87] PCT Pub. No.: WO96/08314

PCT Pub. Date: Mar. 21, 1996

[30] Foreign Application Priority Data

Sep. 15, 1994 [SE] Sweden ..... 9403102

[51] Int. Cl.[6] ..... B04B 5/02

[52] U.S. Cl. ..... 494/19; 494/20; 494/83

[58] Field of Search ..... 494/16, 19, 20, 494/21, 33, 83, 85

[56] References Cited

U.S. PATENT DOCUMENTS

| | | | |
|---|---|---|---|
| 2,604,261 | 7/1952 | Silverstolpe | 494/20 |
| 2,878,994 | 3/1959 | Anderson | 494/20 X |
| 3,028,075 | 4/1962 | Blum | 494/20 |
| 3,266,718 | 8/1966 | Stahl et al. . | |
| 4,624,655 | 11/1986 | Cole | 494/20 |
| 4,659,325 | 4/1987 | Cole et al. | 494/20 |

*Primary Examiner*—Charles E. Cooley
*Attorney, Agent, or Firm*—Klarquist Sparkman Campbell Leigh & Whinston, LLP

[57] ABSTRACT

A centrifuge for rotating test tubes and the like about a rotational axis includes a drive shaft and a plurality of handles connected thereto to support respective test tube attachments. Each test tube attachment includes two concentric rings, an outer ring pivotally connected to the handle by two diametrically opposed radial pivots and an inner ring pivotally connected to the outer ring by two radial pivots arranged perpendicular to the other radial pivots. The inner ring seats an axial bearing which rotatably supports a container capable of holding in place a test tube.

3 Claims, 4 Drawing Sheets

CENTRIFUGE FOR TEST TUBES AND CONTAINERS

The present invention refers to a device at centrifuges, for instance in medical care and research institute laboratories, including one handle rotatable by means of a vertical driving shaft, on which sockets for receiving centrifuge tubes, through movable means of cardanic type are mountable, which sockets during the centrifugation are freely adjustable in direction of the resultant of the forces acting on each socket.

BACKGROUND OF THE INVENTION

For enrichment through centrifugation at research and medical care laboratories, for instance blood donor centres, there are different types of centrifuges, as well as different types of centrifuge tubes for the sample material. Generally, it consists of a liquid having components of different density, where the difference can be minimal. It can be the case when separating suspensions with low concentrations of particles with a minimum possible loss of material or separation of suspensions having a large amount of cells, such as blood, by separating it in different blood components. The sample material can be valuable or in a limited amount, whereby when washing the same a loss can be noticeable.

The dominating types of centrifuges are of fixed angle and swing out types, which are also equipped for, so-called ultracentrifugation. It is performed in the vacuum, to avoid the air resistance, which can be very high at high number of revolutions.

A centrifuge of cardanic type is described in SE-C-129311, which allows quick acceleration and deceleration without damaging effect on the sedimentation or enrichment in case of a small amount of material, at most 100 milliliters. In larger volumes, at quick deceleration a whirlpool is created, then the material will rotate in the tube. Whirlpools in the sample material make some part of the liquid during the retardation phase of the centrifuge turbid.

Another drawback using centrifuge with conventional cylindrical centrifuge tubes is that some part of the sediment adheres to the upper part of the centrifuge tubes instead of being collected on the bottom of it.

THE OBJECT AND THE MOST IMPORTANT FEATURES

The object of the present invention is to provide a centrifuge, in which any whirlpools deteriorating the centrifugation result, are produced not even at relatively quick deceleration. Another object of the invention is to elaborate centrifuge tubes so that material with higher density will not adhere onto the tube walls, but they are practically 100% centrifuged down to the bottom portion of the centrifuge tube. The first-mentioned object has been achieved by means of sockets and thereby the centrifuge tubes are provided rotatably about its own longitudinal axis during the action of deceleration forces at the deceleration of the centrifuge acting on them, that each attachment consists of two concentric rings, a first inner ring, being movable about two diametrically opposing radial pivots, provided in a second outer ring, which in turn is movable about two radial pivots, arranged perpendicular to said former pivots and mounted in the handle, and that at the first inner ring an axial bearing for supporting said socket is arranged. The second object has been achieved by providing the centrifuge tubes with converging inner limiter surfaces at least along some part, preferably the upper part, of its length, extension of said limiter surfaces, when the centrifuge tube is in its horizontal centrifugation position, coincide in a point situated essentially on the centre line of the driving shaft.

DESCRIPTION OF THE DRAWINGS

In the following, the invention will be described with reference to enclosed drawings, which show some embodiments.

FIG. 1 shows the rotor in resting position, FIG. 2 in acceleration position, FIG. 3 in its optimal operation position and FIG. 4 in deceleration position.

DESCRIPTION OF EMBODIMENTS

Figure 1:
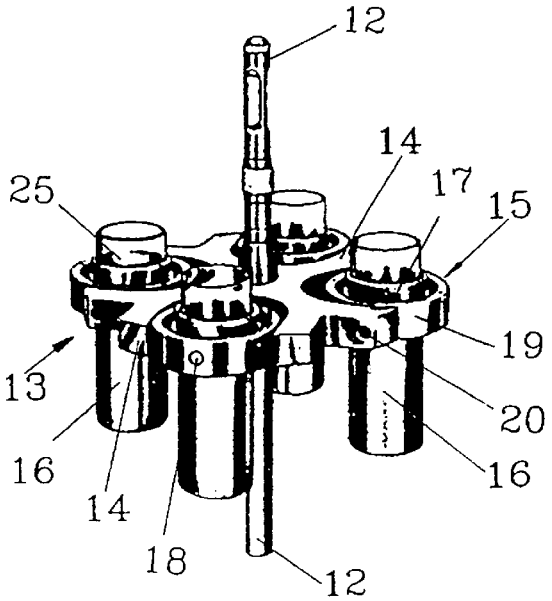
FIGS. 1–4 shows perspectively the rotor of the centrifuge with its movable sockets and centrifuge tubes in different states inserted in it, where

In the FIGS. 1–4 a rotor of a centrifuge is shown, not in detail, which rotor consists of a drive-shaft 12 on which a handle 13 being rheostatly mounted, which in the illustrated embodiment includes four receiver rests 14 for receiving the same number of mobile means 15 of cardanic type, which in turn carries corresponding socket or container 16. The mobile means 15 include two concentric rings, a first inner ring 17, being movable about two diametrically opposite radial pivots 18, provided in a second outer ring 19. This, in turn, is movable about two radial pivots 20, provided perpendicular to pivots 18 and mounted in the handle 13, in the receiver rests 14.

Figure 6:
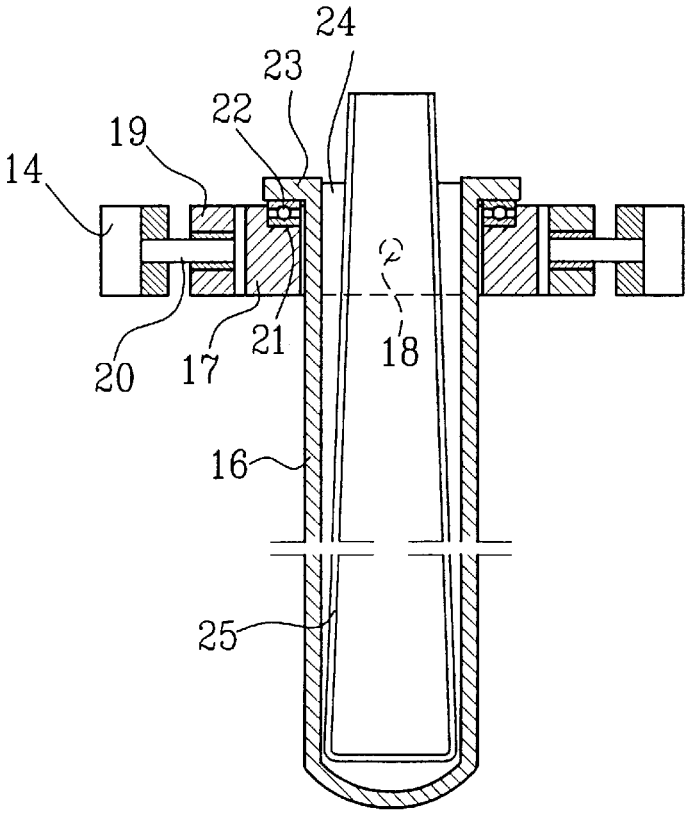
FIG. 6 is yet in a larger scale, a cross-section along the line VI—VI in FIG. 5.

FIG. 6 shows the inner ring 17 is supplied with a shoulder 21, on which an axial bearing 22 rests, which is concentrically arranged with the ring 17 and the socket 16. Preferably, it is arranged with a flange 23 at the opening 24 of the socket and said flange bears on the upper bearing ring of the axial bearing 22.

In each socket 16 a centrifuge tube 25 is insertable, in which the sample material is placed.

Figure 2:
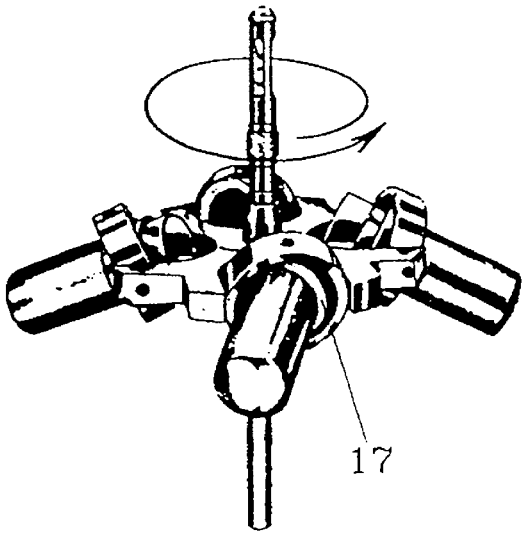
Figure 3:
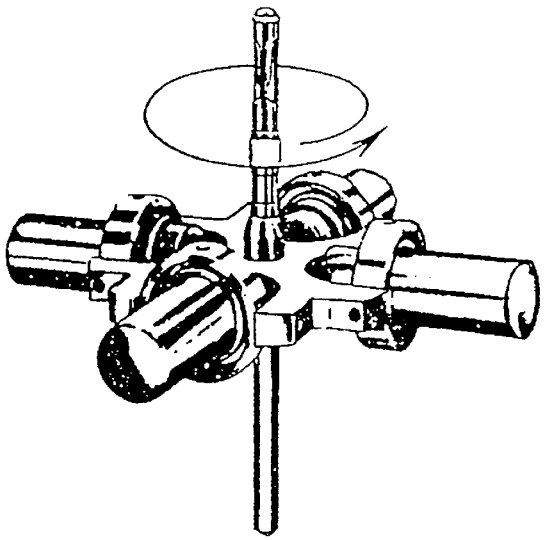
Figure 4:
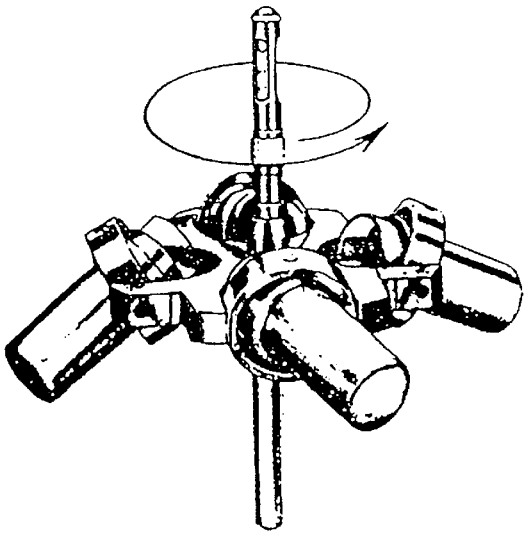
Figure 5:
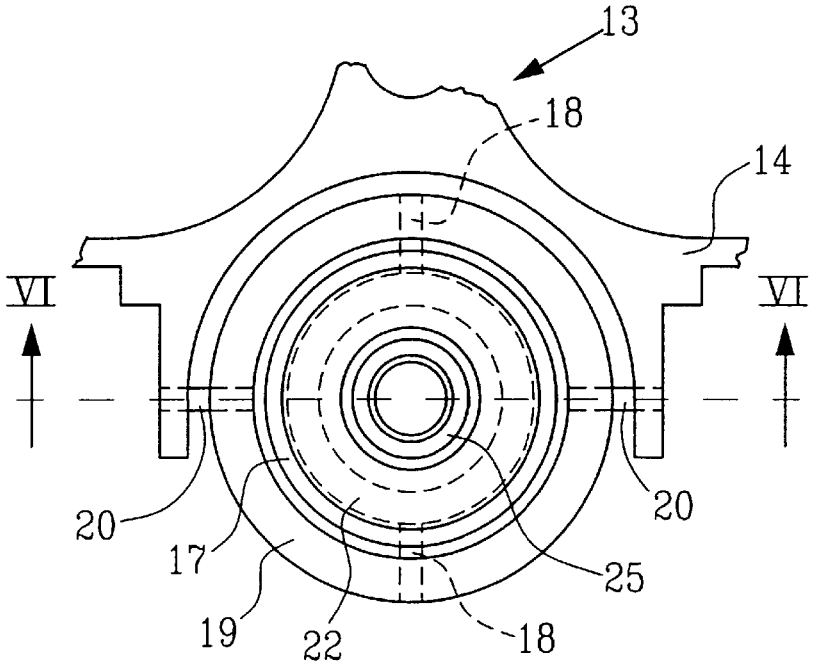
FIG. 5 shows in, an enlarged scale, a part of the handle of the centrifuge in a view from above.

In FIG. 1 the rotor of the centrifuge is shown in a resting position, in which the socket 16 lies in a vertical position in the receiver. If, the rotor of the centrifuge is accelerated, as shown in FIG. 2, the sockets move slightly backwards against the direction of movement of the resultant. Accordingly, the pressure on the centrifuge tubes 25 is reduced when these are not exposed to break strains. The particles of the sample material move in a direction that is principally parallel to the axis of the centrifuge tube, reducing the risk of the sample material adhering onto the walls. In FIG. 3 the rotor has elevated through full revolution, whereby the sockets 16 are in a horizontally radial position. Here, the main enrichment is obtained. During the retardation phase, FIG. 4, a deceleration of the rotor occurs, whereby the friction in both drive-shaft and driving motor effects the sockets 16 to adopt a forward angle in the direction of the movement. By means of the cardan suspension the sockets can follow the resultant of the affecting forces, during this phase, whereby a part of the damaging whirlpool formation in the centrifuge tube is counteracted. The remaining whirlpool formation obtained because of the deceleration is eliminated by the sockets 16 and thereby the centrifuge tube 25 being rotatable about its own longitudinal axis. In relatively small forces that set the sample material in rotation, it is required that the socket 16 provided with the centrifuge tube 25 is easily brought into rotation, which has been achieved by means of the axial bearing 22.

It can be mentioned that the sedimentation and appearance of different cells, particularly the orientation of the cancer cells and inflammatory cells, is affected by the different forces—before, during and after the centrifugation process. As the content of the solid particles and cells in the sample liquid can usually be very small, it is extremely important that the sedimented material is not wasted and adhered on the walls of the centrifuge tube. Thanks to deposition of practically entire material on the bottom of the centrifuge tube, the result of the centrifugation is improved and the reliability of the diagnostic is increased.

Until now centrifuge tubes having a cylindrical form largely have been used, which however has the inconvenience of a particle deposition on the inside of the tube, especially, within the upper part and thus it cannot come down to the bottom of the tube, where one prefers to collect as much portion of the dense particles as possible. Additionally, poor enrichment up to the upper surface of the liquid of fewer dense particles in cylindrical tubes having proportionately wide upper opening is obtained.

It has now been indicated that, said drawbacks are overcome, if the centrifuge tube 25 is tapered with an inner surface converging towards its top opening, such that when the tube is disposed in its horizontal centrifuge position, extension 28 (FIGS. 7, 8) of the tube's inside surface converges toward a point located essentially on the center line of the driving axis 12. As a result, during centrifugation, the dense particles do not adhere onto the upper, inner surface of the centrifuge tube, but they centrifuge down to the bottom of the tube.

At the upper surface of the liquid in the centrifuge tube, an enrichment of particles of lesser density are collected in a small area due to the upward conical shape of the tube, which simplifies the testing, e.g., bacterium samples of tuberculosis, when a sample must be taken both from the surface and the bottom of the centrifuge tube.

Figure 7:
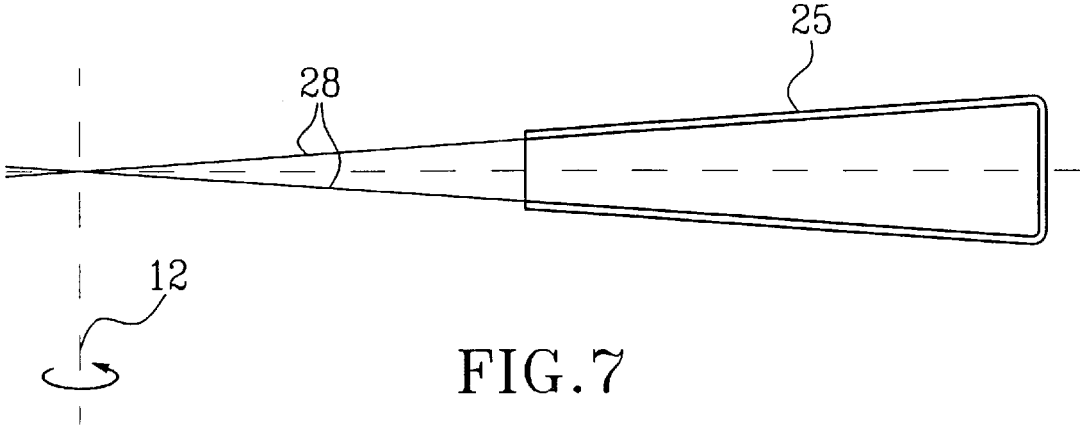
FIGS. 7 and 8 are a lateral view of the centrifuge tube according to two different variants in an optimal operation position.

As it is evident through FIG. 7, the centrifuge tube 25 along its entire length, from the opening to its bottom, is formed by a generatrix, which passes through a point on the centre line of the drive-shaft 12 and forms a conical surface.

Figure 8:
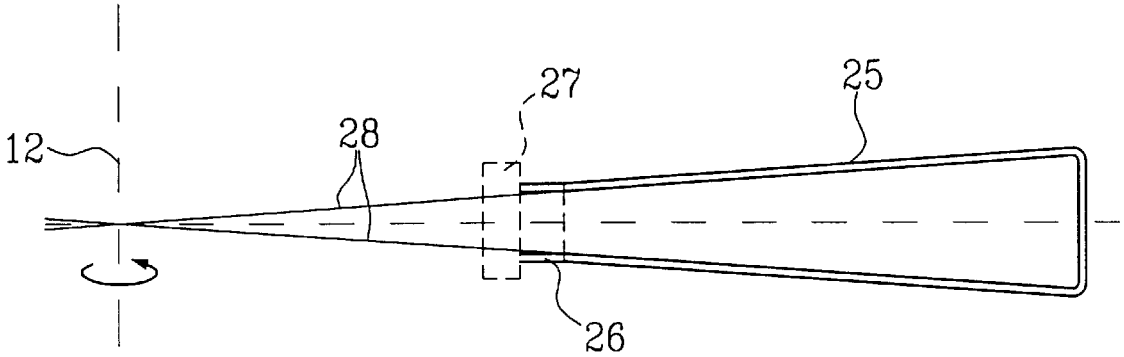

The embodiment shown in FIG. 8 differs from the centrifuge tube 25 shown in FIG. 7 by being equipped with a cylindrical neck 26 at an upper portion of it, to facilitate mounting a cork 27.

The centrifuge tube 25 can also be formed as a tube, having openings in its both ends, which can be tightened by means of corresponding corks. The conical form of the centrifuge tube does not need to extend above the entire tube length and the tube can also be provided with double conic form, which tapers in the direction of said both ends.

Figure 9:
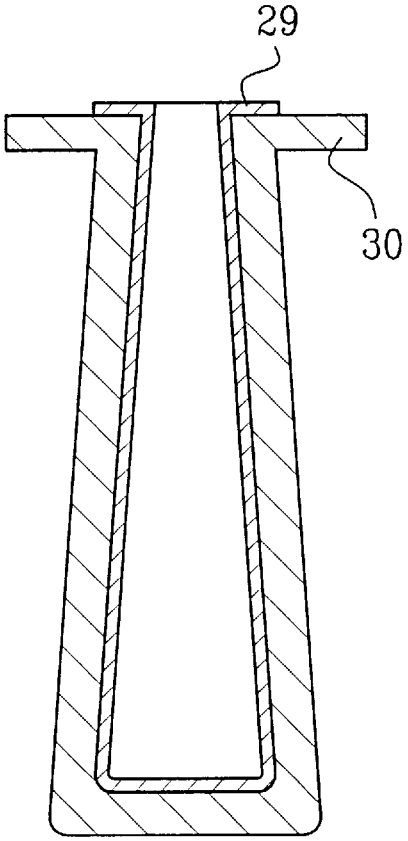
FIG. 9 is a cross section of an alternate embodiment of the test tube and holder wherein the tube is formed as a bag having a tapered form and a corresponding bag holder.

The centrifuge tube may be made of different material, for instance glass, plastic, metal; it can be of disposable type, e.g. paper or the like, but it also can be formed as a bag 29 having conical form and with corresponding bag holders 30, as shown in FIG. 9. The tapering centrifuge tube at the opening may have a supporting flange and/or along the outer side support wings.

The invention claimed is:

1. A centrifuge comprising:

a vertical drive shaft;

a handle rotatably driven by the drive shaft;

a plurality of sockets each adapted to receive a centrifuge tube;

a cardanic movable support to support each socket during centrifugation such that each socket is freely adjustable in the direction of resultant forces acting on the socket;

the cardanic movable support including an outer ring pivotally connected by a first pair of diametrically opposed radial pivots to the handle and an inner ring pivotally connected by a second pair of diametrically opposed radial pivots to the outer ring, the first pair of pivots being substantially perpendicular to the second pair of pivots; and an axial bearing carried on each inner ring to rotatably support the socket and permit each socket to rotate about its longitudinal axis during deceleration of the centrifuge or otherwise.

2. The centrifuge of claim 1 wherein each centrifuge tube has a converging inner surface along at least an upper portion of its length, the inner surface converging to a focal point substantially coincident with an axis defined by the vertical drive shaft when the centrifuge tube is in a horizontal centrifugation position.

3. The centrifuge of claims 1 or 2 wherein the centrifuge tube is formed as a bag having a tapered form and corresponding bag holders.

* * * * *